US007278644B2

(12) United States Patent
Villarreal

(10) Patent No.: US 7,278,644 B2
(45) Date of Patent: Oct. 9, 2007

(54) PORTABLE WORKSPACE FOR LAPTOP COMPUTERS

(76) Inventor: Arthur Villarreal, 4432 W. Terrace, Fresno, CA (US) 93722

( * ) Notice: Subject to any disclaimer, the term of this patent is extended or adjusted under 35 U.S.C. 154(b) by 262 days.

(21) Appl. No.: 10/928,696

(22) Filed: Aug. 26, 2004

(65) Prior Publication Data

US 2005/0099102 A1 May 12, 2005

Related U.S. Application Data

(60) Provisional application No. 60/519,478, filed on Nov. 12, 2003.

(51) Int. Cl.
*B62B 1/26* (2006.01)

(52) U.S. Cl. ..... 280/47.26; 312/223.3; 312/249.8; 190/12 A

(58) Field of Classification Search ..... 280/47.41, 280/47.26; 312/223.3, 249.12, 249.8; 190/11, 190/12 A; 297/139, 135
See application file for complete search history.

(56) References Cited

U.S. PATENT DOCUMENTS

| | | | | | |
|---|---|---|---|---|---|
| 142,418 | A | * | 9/1873 | Taylor | 312/235.2 |
| 676,539 | A | * | 6/1901 | Hall | 312/201 |
| 1,457,041 | A | * | 5/1923 | Orear | 190/12 A |
| 1,712,213 | A | * | 5/1929 | Janicke | 190/12 A |
| 2,453,129 | A | * | 11/1948 | Hinton | 312/290 |
| 2,905,480 | A | * | 9/1959 | Giovannelli | 280/659 |
| 3,777,882 | A | * | 12/1973 | McIntyre | 206/370 |
| 4,114,965 | A | * | 9/1978 | Oye et al. | 312/209 |
| 4,129,213 | A | * | 12/1978 | Fleig | 206/575 |
| 4,564,091 | A | * | 1/1986 | Coneglio | 190/11 |
| 5,302,014 | A | * | 4/1994 | Hobson | 312/249.12 |
| 5,429,432 | A | * | 7/1995 | Johnson | 312/235.3 |
| 5,437,367 | A | | 8/1995 | Martin | |
| 5,528,453 | A | * | 6/1996 | Berman et al. | 361/625 |
| 5,611,553 | A | * | 3/1997 | Schoeman et al. | 280/47.35 |
| 5,893,572 | A | * | 4/1999 | Parks | 280/47.18 |
| 5,979,337 | A | | 11/1999 | Clark et al. | |
| 6,044,758 | A | | 4/2000 | Drake | |
| 6,439,134 | B1 | | 8/2002 | Ryburg | |
| 6,454,064 | B1 | * | 9/2002 | Cheng | 190/11 |
| 6,493,217 | B1 | | 12/2002 | Jenkins, Jr. | |
| 6,520,514 | B2 | * | 2/2003 | Clegg | 280/47.26 |
| 6,597,568 | B2 | | 7/2003 | Ryder | |
| 6,601,861 | B1 | * | 8/2003 | Dettmann et al. | 280/47.35 |
| 6,604,720 | B1 | | 8/2003 | Wilson | |
| D501,285 | S | * | 1/2005 | Long, Jr. | D34/19 |

(Continued)

*Primary Examiner*—Christopher P. Ellis
*Assistant Examiner*—John D Walters
(74) *Attorney, Agent, or Firm*—Richard A. Ryan

(57) ABSTRACT

A portable workspace for laptop computers that includes a main compartment configured to store computer peripherals and work materials in one or more storage spaces therein and a work surface area configured to securely store a laptop computer between a lid pivotally attached to the main compartment and the top surface of the main compartment. A retractable handle assembly is attached to the main compartment and utilized to move the workspace apparatus on wheels rotatably disposed in a wheel compartment at the back of the main compartment. A chair is removably attached to the main compartment so the user can sit on the chair when utilizing the workspace apparatus. One or more side tables are pivotally attached to the sides of the main compartment and configured to form a generally planar working surface with the top surface of the main compartment.

20 Claims, 7 Drawing Sheets

U.S. PATENT DOCUMENTS

2001/0030403 A1* 10/2001 Johnson et al. ..... 280/47.26
2002/0063072 A1 5/2002 Pham
2002/0134697 A1* 9/2002 Barnett ..... 206/320
2003/0080655 A1* 5/2003 Goldberg ..... 312/290

* cited by examiner

PORTABLE WORKSPACE FOR LAPTOP COMPUTERS

CROSS-REFERENCE TO RELATED APPLICATIONS

This application claims the benefit of U.S. Provisional Application No. 60/519,478 filed Nov. 12, 2003.

BACKGROUND OF THE INVENTION

A. Field of the Invention

The field of the present invention relates generally to apparatuses utilized to transport computers, computer peripheral equipment and work materials and, more particularly, to those apparatuses that are then convertible to a workstation to allow the user to work away from the office or home. More specifically, this invention relates to such portable workstations that conveniently and safely transport a computer and work materials and then provide sufficient work space for effective use as a desk.

B. Background

Over the last twenty years or so, the computer has become an important and generally necessary tool that is commonly utilized for business, home, educational and recreational purposes. Early on, certain companies and individuals realized that it would be beneficial to be able to transport the computer and its capabilities to places away from the office or home in order to utilize the computer at the "remote" location. Due to this importance, portable or laptop computers were developed early in the history of computers. Today, laptop computers are used by many people at many different locations, including the office, home and school. The portability of a laptop computer allows the user to work on the computer even while he or she is outdoors, whether at a job site or the beach. While laptop computers greatly improve the ability to do work away from the typical office or home setting, there are still issues with regard to transporting the computer and having space to work on the computer at the remote location. To complicate this matter, utilization of the laptop computer is made more beneficial by being able to utilize various peripheral equipment and work materials with the computer. For instance, many people find it useful to connect the computer to a portable printer, utilize a mouse with the computer and have access to various books or other materials when working on the laptop computer. Transporting all this equipment and material with the computer can be quite difficult. In addition, once at the remote location the user typically finds himself or herself significantly limited on space.

Most currently available laptop carrying devices are no more than large briefcases or small luggage devices that are specially padded to protect the computer from contact damage. The user is still stuck trying to work with the laptop computer on his or her lap or to search out a relatively flat spot on which to place the laptop (i.e., a bench or picnic table). Unfortunately, this can be quite uncomfortable for typing on the computer's keyboard, which can significantly reduce the person's work efficiency. The lack of space and organizational placement of the computer, computer peripherals and other materials compounds this problem. In addition, the presently available laptop carrying devices do not solve the problem of having to carry the computer, its peripheral equipment and any other work materials to the remote location. The user wanting to work on a laptop computer at a remote location is typically stuck having to haul or carry all of the necessary equipment to the remote location, often resulting in multiple trips and/or a precarious balancing act to carry it all at once. Because the computer and some of the other equipment is electronic in nature, dropping it can damage or destroy the equipment.

Various devices are known in the prior art. For instance, U.S. Pat. No. 6,044,758 to Drake and U.S. Pat. No. 5,979,337 to Clark describe portable desk apparatuses that can be used in a remote location. Neither device is configured to carry the combination of laptop, computer peripherals and work materials. U.S. Pat. No. 6,439,134 to Ryburg and U.S. Pat. No. 5,437,367 to Martin describe luggage carriers or cases wherein a portion of the device opens up as a table on which to place the laptop computer. Neither device provides a significant amount of work surface and neither device is configured to carry, in a concise and safe manner, the peripheral equipment or work materials. U.S. Patent Application Pub. No. US2002/0063072 to Pham describes a computer case/table configured similar to a wheeled luggage carrier that unfolds into a laptop table having retractable telescoping legs with a lower printer compartment and an outwardly extending retractable mouse board. U.S. Pat. No. 6,597,568 to Ryder describes a carrying case for a mobile office that has a portion thereof that folds open to use as a work space and is configured to transport and hold a portable printer. Neither the Pham or Ryder apparatuses are configured to carry much more than the computer and the printer. U.S. Pat. No. 6,604,720 to Wilson describes a tripod type of portable work station that opens up to have multiple work surfaces. The Wilson device is not configured to carry the laptop computer or any peripheral equipment or work materials. U.S. Patent Application Pub. No. US2002/0134697 to Barnett discloses a portable laptop workstation that is pulled like a luggage carrier but unfolds into a upright frame that has a support surface for a laptop and a printer. U.S. Pat. No. 6,493,217 to Jenkins, Jr. describes a mobile workstation with power supply system that includes a battery and DC/AC converter to supply power to the laptop and/or computer peripherals on the workstation. U.S. Patent Application Pub. No. US2003/0080655 to Goldberg describes a portable work station that has a storage compartment for the laptop computer positioned on top of the mobile cabinet. None of the foregoing devices, or any other known devices in the prior art, provide the user with an apparatus that is suitable for storing a laptop computer, peripheral equipment, work materials and a chair for use with the foregoing in a manner that allows safe and easy transport of these materials to a remote location and then provides the user with an efficient and effective workspace or station where he or she can work on the laptop computer, utilize the peripheral equipment and access the work materials.

What is needed is a portable workspace for laptop computers that can efficiently and effectively store and transport a laptop computer and its peripheral equipment and which provides a suitable amount of workspace that allows the user to accomplish the desired tasks. In particular, a portable workspace apparatus is needed that allows the user to easily transport his or her materials to a remote location and then set up a suitable working area so that he or she may be able to accomplish the desired objectives. The preferred portable workspace apparatus should be adaptable to a variety of different types of laptop computers, peripheral devices and working materials and be easy to setup or take down when ready to work or transport the materials. In addition, the preferred workspace apparatus includes a chair configured to allow the user to sit on and access the laptop computer and other materials.

SUMMARY OF THE INVENTION

The portable workspace for laptop computers of the present invention provides the benefits and solves the problems identified above. That is to say, the present invention discloses a portable workspace apparatus that is adaptable to carrying a laptop computer, a variety of computer peripheral equipment (such as a printer, projector, scanner, modem and/or external storage device) and various work materials (including books, paper, writing/drawing instruments, notebooks, catalogs and reference materials). The portable workspace apparatus of the present invention safely transports the computer and related peripheral equipment and provides a substantial amount of working surface for the user when opened up. The portable workspace apparatus of the present invention also includes a chair for the user to sit on while he or she works on the computer. As such the portable workspace apparatus allows the user to be much more efficient and effective at the remote location than is presently possible with currently available portable workspace/workstation apparatuses.

In one general aspect of the present invention, the portable workspace for laptop computers of the present invention includes a main compartment that is defined by a front, back, pair of opposing sidewalls, bottom and top surface and configured to form one or more subcompartments having one or more storage spaces therein. In the preferred embodiment, main compartment includes a first subcompartment configured with a drawer slidably disposed in the main compartment and a second subcompartment configured with two or more storage spaces that are divided by a moveable shelf member. One or more doors are attached to the main compartment and configured to enclose the one or more storage spaces, or if desired, the storage spaces and the drawer. A lid, having a lid body, is pivotally attached to the main compartment and sized and configured to substantially enclose the top surface of the main compartment. In the preferred embodiment, the lid has one or more cushioning members disposed inside the lid body and a mouse housing. The cushioning members are configured to secure a laptop computer inside the workspace apparatus between the lid and the top surface. The mouse housing can be configured to secure a computer mouse on top of the laptop computer. A retractable handle assembly is attached to the main compartment, preferably at the back of the main compartment, and is configured with a handle storage housing, a handle configured to be received in the handle storage housing and a handle grip attached to the handle so the user can retract the handle and hold the handle grip to roll the workspace apparatus to its desired location. To facilitate moving the apparatus, the preferred embodiment includes a pair of wheels rotatably disposed inside a one or more wheel compartments at the back of the main compartment. Also in the preferred embodiment, workspace apparatus includes a chair removably attached to the main compartment and one or more chair hangers that are sized and configured to releasably secure the chair to the main compartment. The preferred workspace apparatus also includes one or more side tables pivotally attached to the main compartment and configured to move between a lowered position and a raised position. Preferably, the side tables are in a generally planar relationship with the top surface when at the raised position to form a generally planar working surface. The workspace apparatus includes a mechanism attached to the main compartment for supporting the side tables in the raised position and a securing mechanism for securing the side tables to the main compartment when in the lowered position. The side table supporting mechanism can comprise a hinged support frame that is configured to cooperatively engage a table block to support the side tables. The workspace apparatus of the present invention can be utilized as a portable/mobile workspace or station allowing the user to have easy and efficient access to a laptop computer, one or more computer peripherals and one or more work materials (such as paper, notebooks, catalogs and the like).

Accordingly, the primary objective of the present invention is to provide a portable workspace apparatus that provides the advantages discussed above and that overcomes the disadvantages and limitations associated with presently available portable workspace apparatuses.

It is also an important object of the present invention to provide a portable workspace apparatus for use with laptop computers that effectively stores peripheral equipment and work materials for transport and which can be easily converted to an efficient workspace when necessary.

It is also an important objective of the present invention to provide a portable workspace apparatus that can effectively serve as an all-in-one workspace by having the laptop computer, peripheral equipment and any desired work materials in an easily accessible and functional location.

It is also an important objective of the present invention to provide a portable workspace apparatus that easily opens up to provide the user with an effective amount of work surface.

It is also an important object of the present invention to provide a portable workspace apparatus that includes a retractable handle for pulling the apparatus and a removable chair for the user to sit on when he or she accesses the laptop computer, peripheral equipment or work materials stored on the apparatus.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, and particularly with reference to the embodiments of the portable workspace for laptop computers of the present invention illustrated in the attached figures, various preferred embodiments of the present invention are set forth below. The enclosed description and drawings are merely illustrative of preferred embodiments and represent several different ways of configuring the present invention. Although specific components, materials, configurations and uses of the present invention are illustrated and set forth in this disclosure, it should be understood that a number of variations to the components and to the configuration of those components described herein and in the accompanying figures can be made without changing the scope and function of the invention set forth herein.

Figure 1:
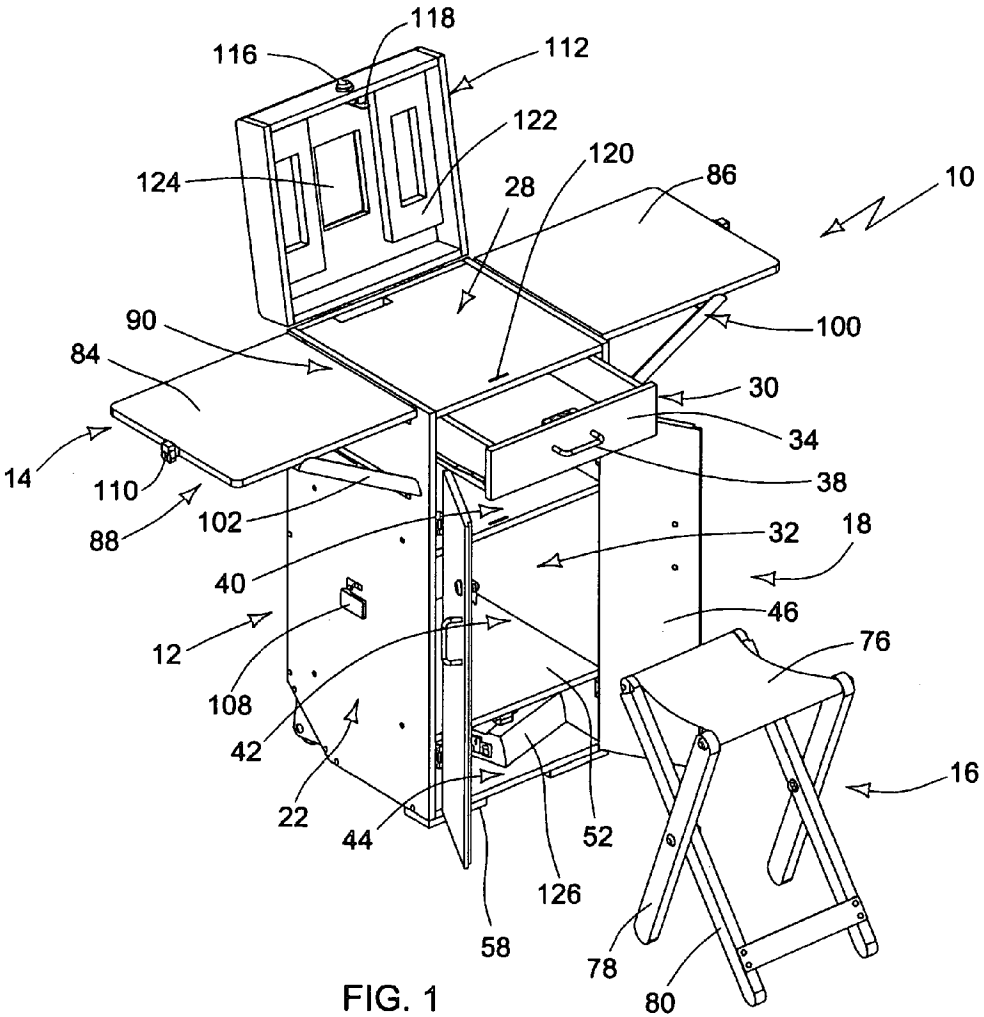
FIG. 1 is a front perspective view of the portable workspace apparatus of the present invention showing the workspace apparatus opened up and with the chair placed in front thereof.
Figure 2:
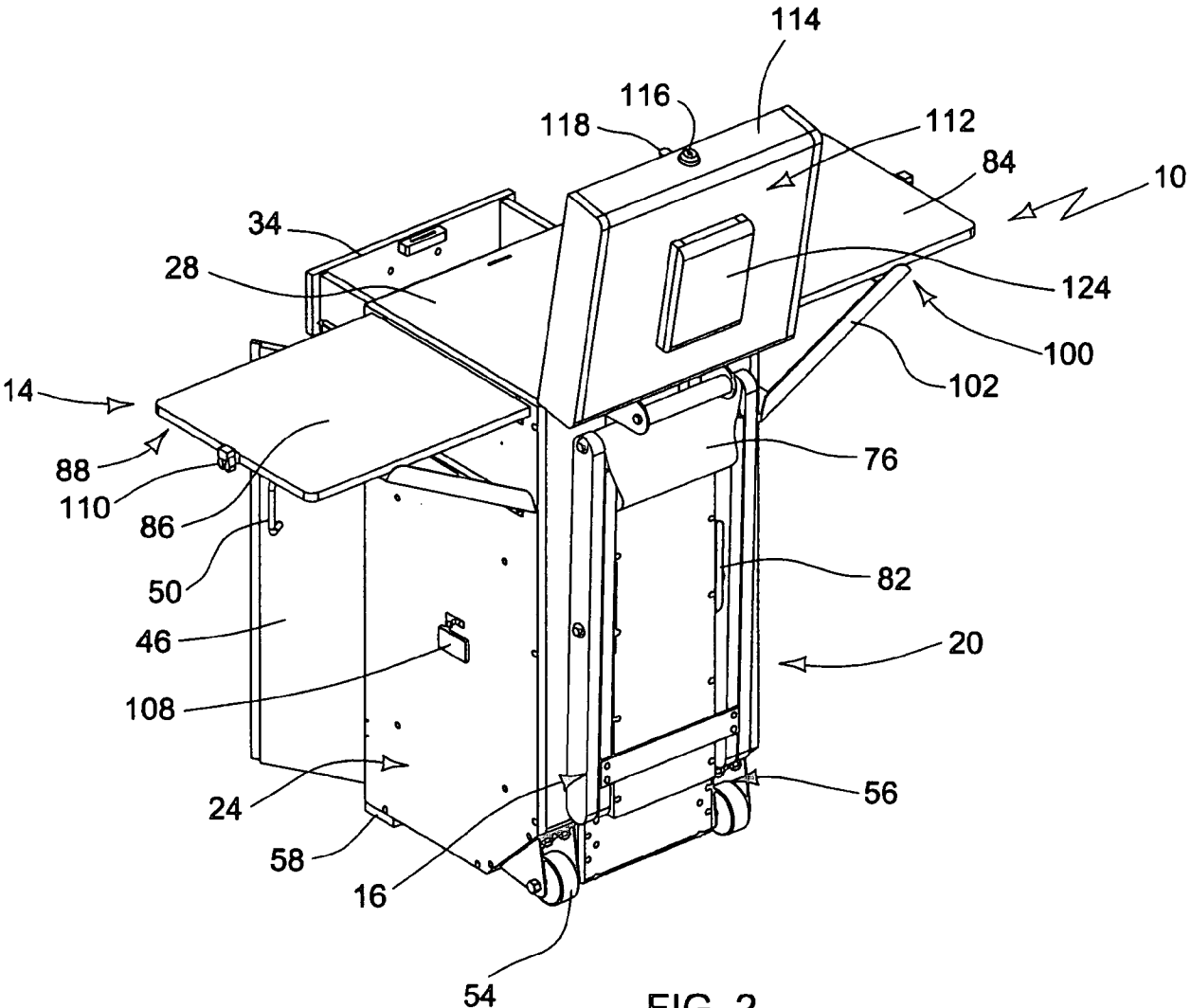
FIG. 2 is a rear perspective view of the portable workspace apparatus of FIG. 1 showing the portable workspace apparatus opened up with the chair mounted on the back of the apparatus.
Figure 3:
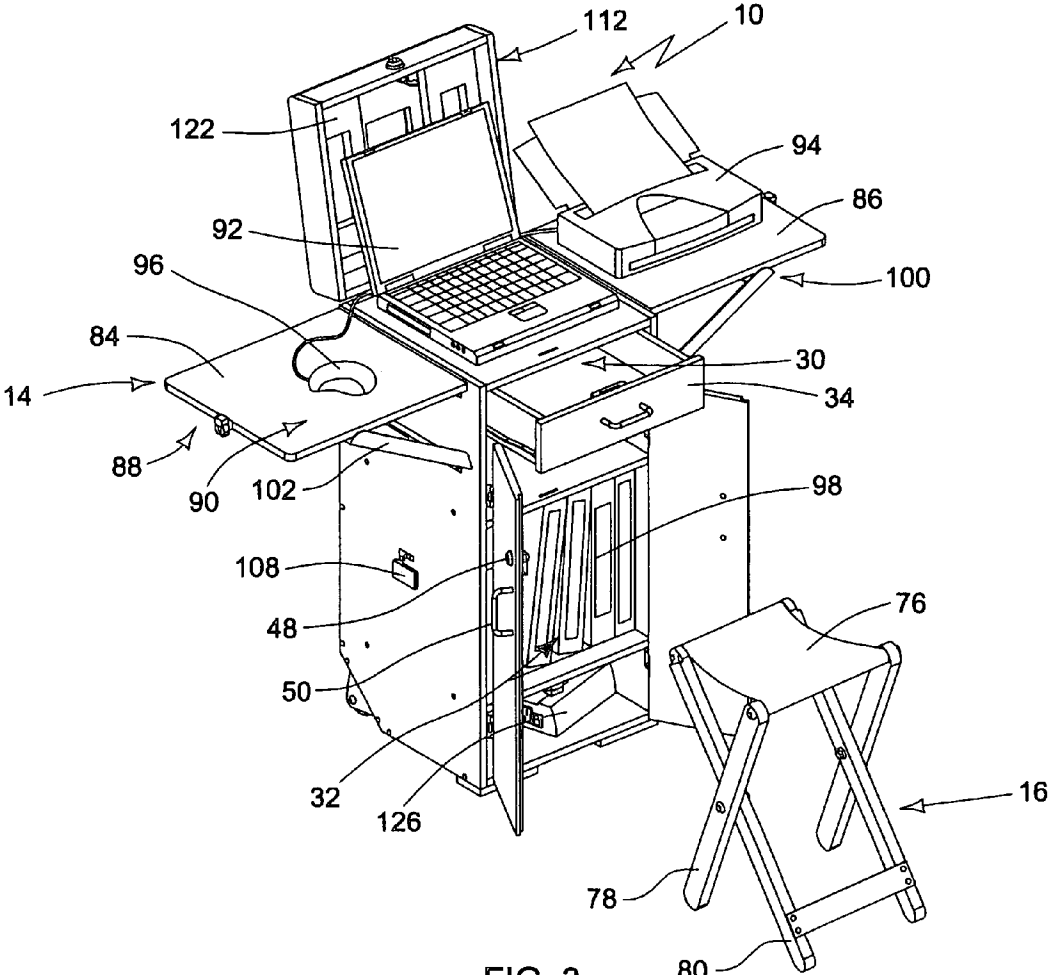
FIG. 3 is a front perspective view of the portable workspace apparatus of FIG. 1 showing a laptop computer, printer, computer mouse and work materials placed thereon.
Figure 8:
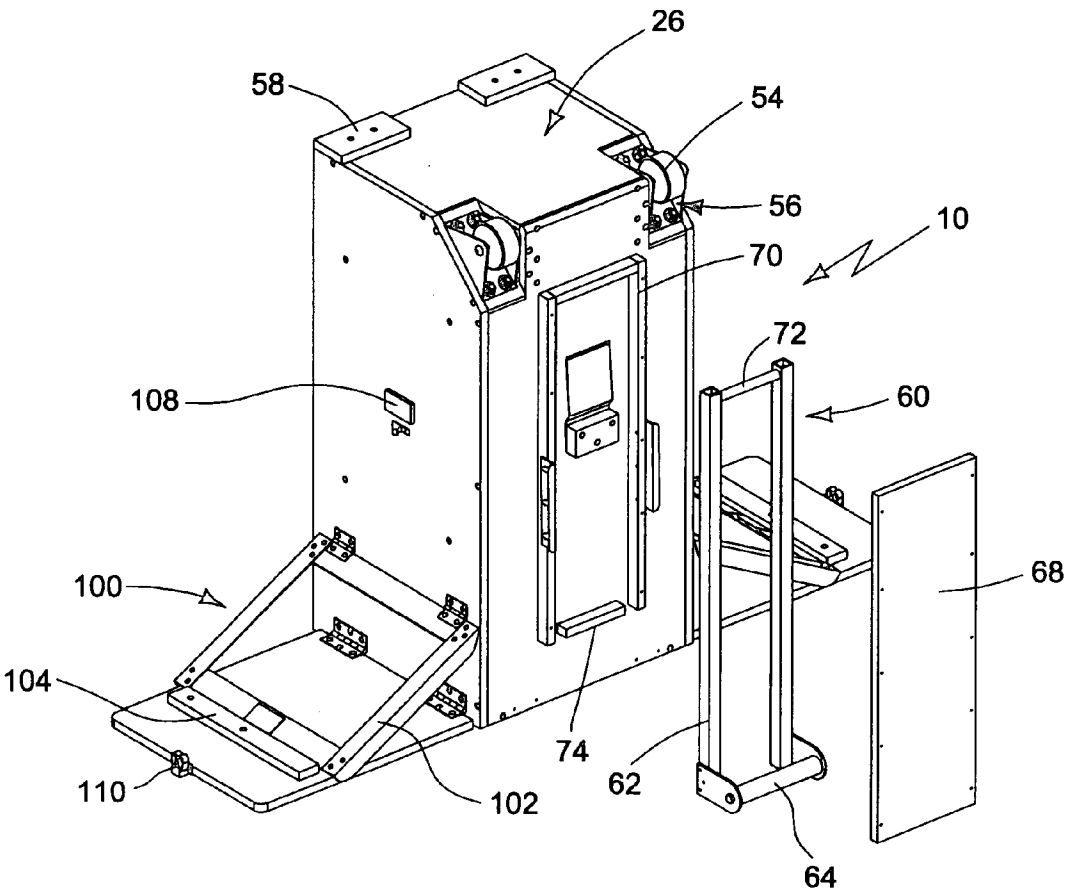
FIG. 8 is a partially exploded rear perspective view showing the retractable handle assembly for use with the present invention.

In a preferred embodiment of the portable workspace apparatus of the present invention, shown in the figures, the workspace apparatus is identified generally as 10. As best shown in FIGS. 1 and 2, portable workspace apparatus 10 has a main compartment 12, a work surface area 14 and a chair 16. As best shown in FIGS. 1, 2 and 8, main compartment 12 is defined by front 18, back 20, a pair of opposing sidewalls 22 and 24, bottom 26 and top surface 28. As shown in FIGS. 1 and 3, main compartment 12 is divided into two subcompartments, a first subcompartment 30 and a second subcompartment 32. In the preferred embodiment, first subcompartment 30 comprises a drawer 34 that is configured to slide or roll in and out of main compartment 12. As known to those skilled in the art, drawer 34 is generally configured with a sliding mechanism 36 having cooperating components on the inside of sidewalls 22 and 24 and on drawer 34 and with a handle 38 to allow the user to easily pull drawer 34 out of first subcompartment 30. Also in the preferred embodiment, as shown in the figures, second subcompartment 32 includes one or more storage spaces, such as first storage space 40, second storage space 42 and third storage space 44, that are enclosed by a pair of doors 46 on the front 18 of workspace apparatus 10 that are hingedly attached to main compartment 12 to allow selective access to the interior of storage spaces 40, 42 and 44. Doors 46 are shown in the open condition in FIGS. 1, 2 and 3 and in the closed condition in FIG. 4. As known to those skilled in the art, doors 46 can include a locking mechanism 48 so the user can lock doors 46 to securely enclose storage spaces 40, 42 and 44 and handles 50 for ease of opening and closing doors 46. Locking mechanism 48 can be of the type that comprises a mechanical key lock on one door that has an elongated strip which rotates in response to turning the lock with the key to move in or out of a slot on the opposite door. This type of locking mechanism 48 is commonly utilized on storage cabinets and similar apparatuses. As also known by those skilled in the art, storage spaces 40, 42 and 44 can be separated by one or more shelves 52 that can be configured to slide out, partially or nearly completely, of main compartment 12 and/or be adjustable within main compartment 12 so as to form selected sizes of storage spaces 40, 42 and 44.

As best shown in FIG. 2, main compartment 12 includes a rolling mechanism, shown as wheels 54 on back 20 of workspace apparatus 10, suitable for allowing the user to roll workspace apparatus 10 from one location to another. As known to those skilled in the art, a variety of different types of wheels 54 are suitable for apparatus 10, including wheels 54 made out of rubber, plastic, metal or other materials. In the preferred embodiment, best shown in FIGS. 2 and 8, a pair of wheels 54 are rotatably contained in wheel compartment 56 at the bottom of back 20 of workspace apparatus 10. Wheels 54 may be of the simple axle type, as shown, or be configured with swivel mountings or their equivalent. As shown the preferred embodiment of the present invention only has wheels 54 at the bottom of back 20 such that when the user tilts workspace apparatus 10 rearward he or she can easily roll workspace apparatus 10 to the location where its use is desired. To maintain a level workspace apparatus 10 when stopped, the preferred embodiment includes a pair of front leveling members 58, best shown in FIG. 8, attached to the bottom 26 at the front 18 of workspace apparatus 10. Preferably, front leveling members 58 are sized and configured to achieve a substantially level top surface 28 when workspace apparatus 10 is in use. If desired, wheels 54 can be configured to be retractable such that they retract inside wheel compartment 56 when not needed to move workspace apparatus 10.

Figure 5:
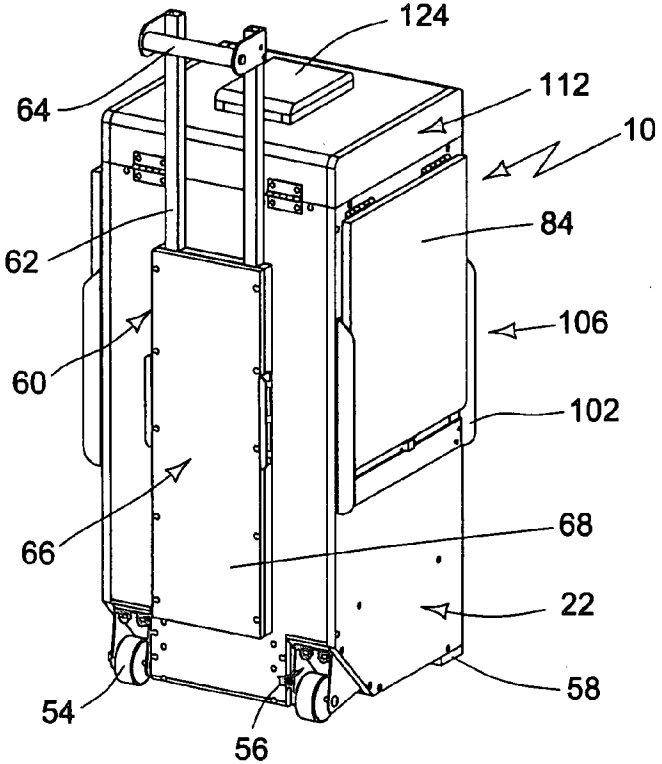
FIG. 5 is a rear perspective view of the portable workspace apparatus of FIG. 1 in the closed condition showing the handle assembly of the retracted and ready for movement.
Figure 7:
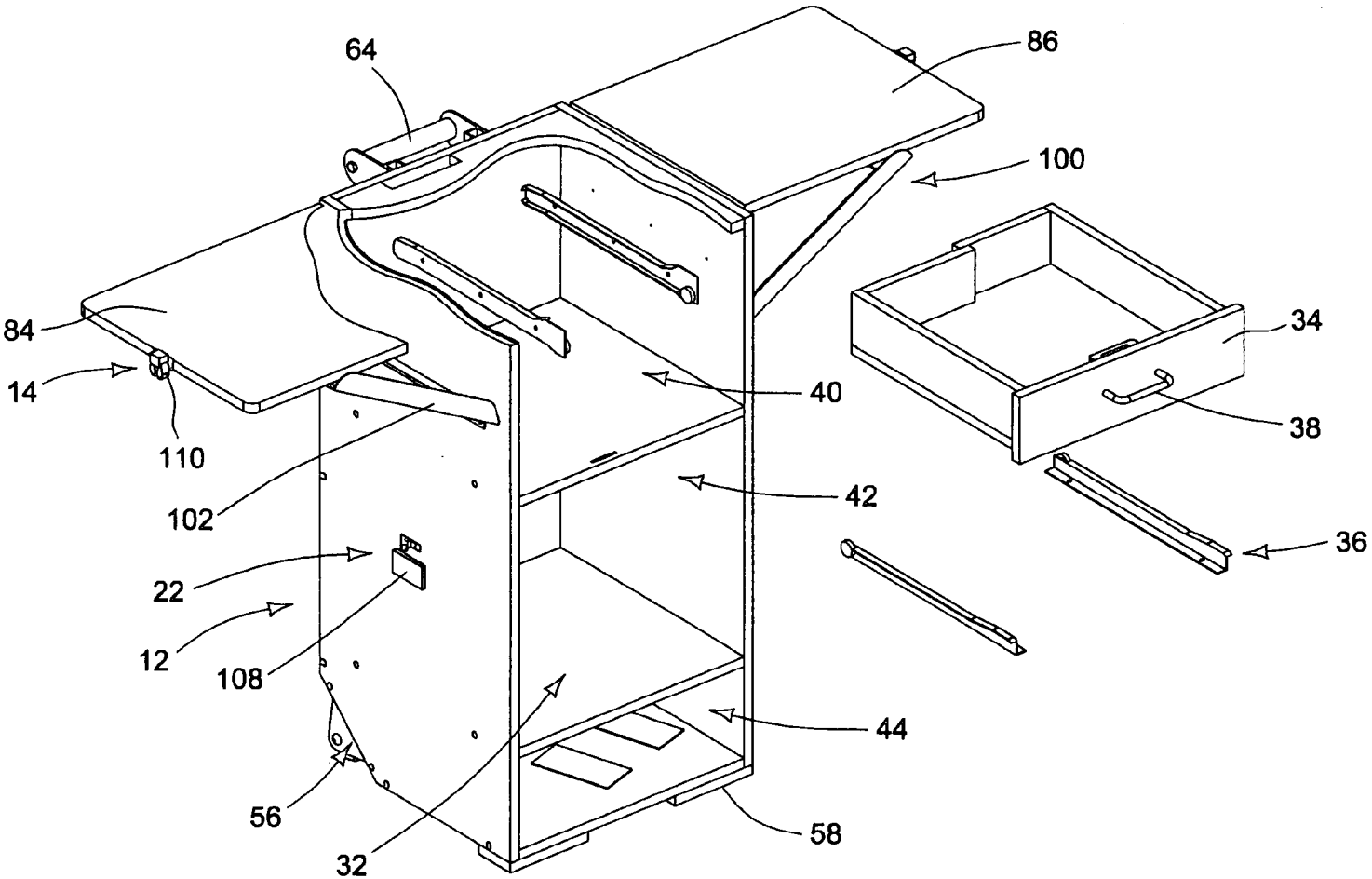
FIG. 7 is a front perspective, partial cross-sectional view of the portable workspace apparatus of the present invention showing a sliding mechanism for use with the drawer component.

Also mounted on the back 20 of main compartment 12 of the preferred workspace apparatus 10, is handle assembly 60 having a retractable handle 62 with handle grip 64, as best shown in FIGS. 5 and 8. In this configuration, handle assembly 60 also comprises a handle storage housing 66 formed by handle plate 68 mounted onto handle frame 70. Inside handle storage housing 66, frame 70 includes a frame stop 72 that is in cooperating relationship with handle stop 74 so as to prevent handle 62 from being completely removed from handle storage housing 66. This type, as well as various other configurations, are generally well known to those skilled in the art. As utilized in many luggage-type of devices, the user grasps handle grip 64 to pull retractable handle 62 out of handle assembly 60 so that workspace apparatus 10 can be tilted rearward and rolled on wheels 54. When not in use for rolling apparatus 10, handle 62 is pushed down and out of the way inside handle storage housing 66 of handle assembly 60. If desired, handle 62 can be have telescopically retractable handle members (not shown) that are telescopically received inside handle storage housing 66 when not used to roll workspace apparatus 10. Various configurations for telescopically configured handle members for handle 62 are also generally well know to those skilled in the art. Handle assembly 60, and more specifically handle 62 and handle grip 64, can be made of a variety of lightweight, strong materials, such as various plastics, metals (i.e., aluminum) and composites. Handle grip 64 should be configured for the user to easily and comfortably grip with his or her hand.

In the preferred embodiment, back 20 of workplace apparatus 10 is configured to securely receive chair 16 thereon such that chair 16 can be stored and transported with workspace apparatus 10 until it is needed. In the preferred embodiment, chair 16 is the folding camp-style stool that can be unfolded so the user can sit on seat 76 supported by legs 78 and 80. To removably secure chair 16 to workplace apparatus 10, the preferred embodiment includes a pair of chair hangers 82 that are fixedly mounted to the outside of handle storage housing 66. Preferably, chair hangers 82 are shaped and configured to "grasp" onto the folded legs 78 and 80 of chair 16. To accomplish this, handle storage housing 66 and chair 16 should be cooperatively sized and shaped such that chair 16, when in its folded condition, is able to be placed around handle storage housing 66. As known to those skilled in the art, legs 78 and 80 of chair 16 can be made out a variety of materials, including wood, metal, plastics and other materials. Seat 76 can also be made out of a variety of seat-type of materials, including canvas, cloth, plastic and others. Preferably, the materials selected for chair 16 are both generally lightweight, sufficiently strong and somewhat durable for use as a chair 16 to be utilized with workspace apparatus 10. The use of chair 16 provides a more ergonomically acceptable use of workspace apparatus 10 with a laptop computer than the normal circumstances in which laptop computers are used (i.e., laps, chairs or other ad hoc surfaces).

Figure 6:
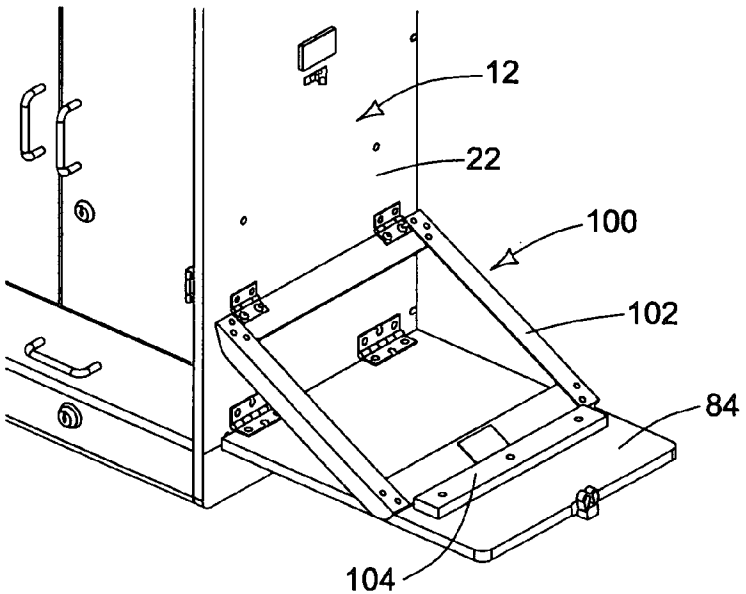
FIG. 6 is a front perspective view of the underside of one of the side tables of the present invention.

As best shown in FIGS. 1-3 and 8, work surface area 14 comprises top surface 28 of main compartment 12 and a pair of side tables 84 and 86. As shown, side tables 84 and 86 are pivotally attached, with hinges or like devices, to sidewalls 22 and 24 of main compartment 12 and configured so as to provide, when placed in the raised position 88 shown in these figures, is generally even with top surface 28 to provide a substantially planar working surface 90 across the top of workspace apparatus 10 of the present invention. As shown in FIG. 3, working surface 90 should be sufficiently wide and deep enough to provide the user with an effective area on which to place laptop computer 92 with additional room for printer 94, computer mouse 96 and/or any work materials 98 (shown stored in second subcompartment 32). In the preferred embodiment, shown in the figures, side tables 84 and 86 are configured to raise and lower along sidewalls 22 and 24 of main compartment 12 and, when in the raised position 88, be supported by table support mechanism 100, best shown in FIGS. 6 and 8. In the preferred embodiment, support mechanism 100 comprises a hinged support frame 102 that is configured to raise and engage table block 104 or other mechanism, including a latch-type mechanism, on the underside of side tables 84 and 86. When not in use, and therefore placed in lowered position 106 shown in FIGS. 4 and 5, side tables 84 and 86 are configured to securely hang downward along sidewalls 22 and 24 of workspace apparatus 10. In the preferred embodiment, workspace apparatus 10 includes an engaging mechanism 108 on sidewalls 64 and 66 of main compartment 12 and cooperating latch mechanism 110 on side tables 84 and 86, as best shown in FIGS. 1, 2 and 8, that are suitable for securing side tables 84 and 86 to main compartment 12 when not in use as work surface 90 (particularly when workspace apparatus 10 is being moved). As known in the art, engaging mechanism 108 and latch mechanism 110 can include various lock-type mechanisms, magnetic devices, hook and loop material and other mechanisms that allow secure but easily removed connection between side table 84 and sidewall 22 and side table 86 and sidewall 24.

Figure 4:
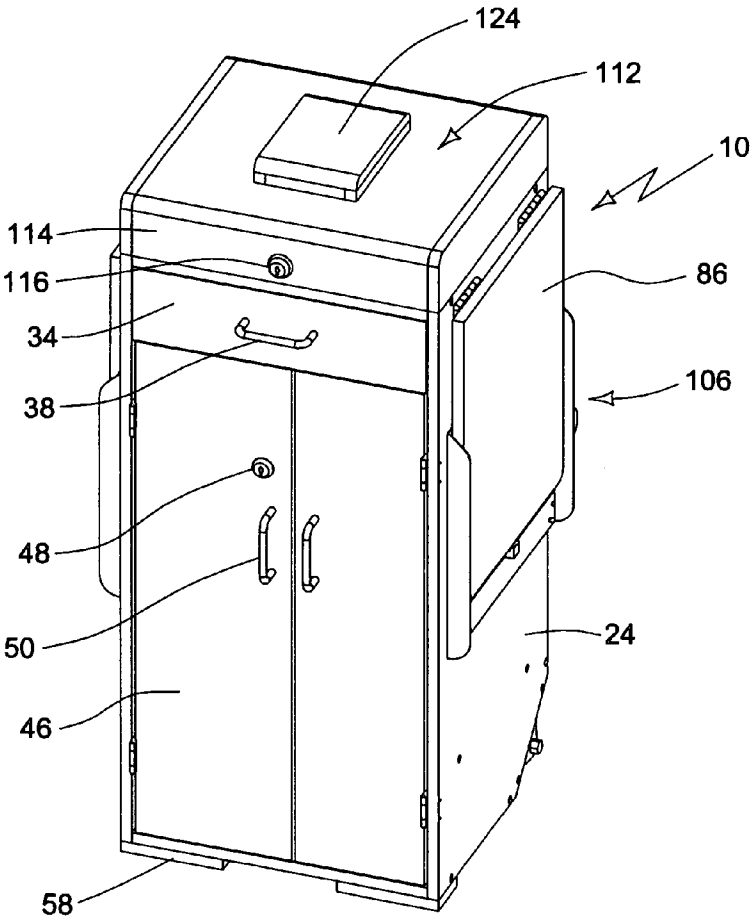
FIG. 4 is a front perspective view of the portable workspace apparatus of FIG. 1 in the closed condition.

The preferred embodiment of workspace apparatus 10 of the present invention also has a lid 112 that is pivotally attached, with hinges or like devices, to main compartment 12 so that lid 112 can be raised and lowered as desired, as shown in the raised position in FIGS. 1-3 and the lowered position in FIGS. 4 and 5. In the preferred embodiment, lid 112 comprises a main lid body 114 that substantially encloses top surface 28 of main compartment 12 and a locking mechanism 116 to secure lid 112 in a closed position. Locking mechanism 116 can be of the type that comprises a mechanical key lock on one door that has an elongated strip 118 which rotates in response to turning the lock with the key to move in or out of a slot 120 on top surface 28 (as shown in FIGS. 1 and 2). To facilitate safe movement of laptop computer 92 on top surface 28 under lid 112, one or more cushioning members 122 are attached to the underside of main lid body 114 and selectively configured to substantially prevent movement of laptop computer 92 when workspace apparatus 10 is being moved. Although it may be possible to utilize a single configuration of cushioning members 122, because different laptop computers 92 are sized differently, it may be advantageous to specially configure cushioning members 122 to fit particular sized laptop computers 92. As with other cushioning systems, workspace apparatus 10 can be provided with cushioning members 122 that are removable and able to be selectively configured by the user for his or her laptop computer 92. Various well known materials are readily available for cushioning members 122, including Styrofoam, foam, rubber, soft plastics and other relatively impact resistant materials that will protect laptop computer 92 between main lid body 114 and top surface 28. If desired to further protect laptop computer 92, top surface 28 can also be covered or coated with a cushioning material (not shown), which can be made removable to allow the user to fully utilize working surface 90 as a planar surface. The preferred embodiment of lid 112 also includes mouse housing 124, best shown in FIGS. 1, 2 and 4, that is sized and configured to allow computer mouse 96 to be placed on top of laptop computer 92 while secured between the closed lid 112 and top surface 28. In this manner, computer mouse 96 is readily available when the user opens lid 112 to use laptop computer 92.

While the workspace apparatus 10 of the present invention can be configured to transport and allow the user to utilize various types of computer equipment and materials, the preferred embodiment will at least include one power inverter (DC to AC), shown as 126 in FIGS. 1 and 3, connected to an extra rechargeable battery (not shown) suitable for powering laptop computer 92 and/or any other computer peripherals, such as portable printer 94 or a light source (not shown). In this manner, the user can plug his or her laptop computer 92 and/or other equipment into inverter 126 when other, non-portable, power sources are not available. As known in the art, backup batteries having five or more hours of power are available for use with laptop computers 92 and peripheral equipment. The rechargeable backup battery can be connected to a battery charger when workspace apparatus 10 is not in use so the backup battery is always charged and ready for use.

In use, the user places his or her laptop computer 92 on top surface 28 under lid 112. Computer mouse 96 is placed on top of laptop computer 92 to be held in place under mouse housing 124. Upon closing lid 112 onto main compartment 12, cushioning members 122 will safely and securely hold laptop computer 92 in place on top surface 28 with computer mouse 96 in mouse housing 124. Locking mechanism 116 will help prevent laptop 92 from being easily stolen, which can be a particular problem when workplace apparatus 10 is being used in an outdoor or other "remote" location. Laptop computer 92 and/or peripheral equipment, such as printer 94, can be connected (selectively) to power inverter 126. As shown in FIGS. 1 and 3, power inverter 126 can be placed out of the way in the third storage space 44, along with the backup battery (not shown). Pencils, paper, drawing tools and other miscellaneous items can be stored in drawer 34 in first subcompartment 30. As shown in FIG. 3, portable printer 94, scanner and/or other peripheral devices can be placed in first storage space 40. As also shown in FIG. 3, second storage space 42 can be utilized to store books, notebooks, catalogs, reference materials or other such materials in a generally upright position. If desired, the user's lunch or other materials can also be placed in one of the storage areas 40, 42 and 44. Locking mechanism 48 can be used to secure the equipment and materials inside main compartment 12. When the user desires or needs to work in a "remote" location, he or she merely extends retractable handle 62, tilts the closed workspace apparatus 10 rearward and rolls workspace apparatus 10 on wheels 54 to a vehicle for transport or directly to another location where it can be used as a workstation. Although various materials can be used for workspace apparatus 10, materials such as various plastics are desired for their lightweight yet strong, durable and generally corrosion/weather resistant characteristics. As known to those skilled in the art, materials that are too heavy will limit the ability of the user to easily move workspace apparatus 10. Once workspace apparatus 10 is in place, the user merely has to push handle 62 into handle storage housing 66, unlock locking mechanism 48 to open doors 46 for access to main storage compartment 12, unlock locking mechanism 116 to raise lid 112 to access laptop computer 92 and computer mouse 96, and then release side tables 84 and 86 and raise them from the lowered position 106 to the raised position 88 to form, with top surface 28, a substantially planar working surface 90. Chair 16 is removed from chair hangers 82 on back 20 of workspace apparatus 10 and placed in front of workspace apparatus 10 to allow the user to sit thereon while working with laptop computer 92, mouse 94 and/or work materials 98. One major benefit of chair 16, is that laptop 92 will be more ergonomically adjusted to the user than most presently available ad hoc uses of laptop computer 92.

While there are shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use. For instance, there are numerous components described herein that can be replaced with equivalent functioning components to accomplish the objectives of the present invention. One such modification is the use of different materials than those set forth herein.

What is claimed is:

1. A portable workspace apparatus for use with a laptop computer, one or more computer peripherals, one or more work materials and a chair, said workspace apparatus comprising:

a main compartment having a front, a back, a pair of opposing sidewalls, a bottom and a substantially planar top surface forming one or more subcompartments having one or more storage spaces therein, said top surface sized and configured to receive and support said laptop computer;

one or more doors attached to said main compartment and configured to enclose said one or more storage spaces, said doors configured to open and allow said chair to be positioned at said front of said main compartment for ergonomic use of said laptop computer when placed on said top surface;

a lid pivotally attached to said main compartment, said lid having a lid body sized and configured to substantially enclose said laptop computer between said lid and said top surface;

a retractable handle assembly attached to said main compartment, said handle assembly having a handle storage housing, a handle configured to be received in said handle storage housing and a handle grip attached to said handle; and means attached to said main compartment for rolling said workspace apparatus.

2. The workspace apparatus according to claim 1, wherein said chair is removably attached to said main compartment.

3. The workspace apparatus according to claim 2, wherein said main compartment has one or more chair hangers sized and configured to releasably secure said chair to the exterior of one of said front, back or sidewalls of said main compartment.

4. The workspace apparatus according to claim 1, wherein said main compartment has a first subcompartment and a second subcompartment, said first subcompartment configured with a drawer slidably disposed in said main compartment, said second subcompartment configured with two or more storage spaces.

5. The workspace apparatus according to claim 1, wherein said work surface area further comprises one or more side tables pivotally attached to said main compartment and configured to move between a lowered position and a raised position.

6. The workspace apparatus according to claim 5, wherein said one or more side tables are in a generally planar relationship with said top surface when at said raised position to define a substantially planar working surface with said top surface.

7. The workspace apparatus according to claim 5 further comprising means attached to said main compartment for supporting said one or more side tables when placed in said raised position.

8. The workspace apparatus according to claim 7 further comprising means for securing said one or more side tables to said main compartment when placed in said lowered position.

9. The workspace apparatus according to claim 7, wherein said supporting means comprises a hinged support frame and a table block, said support frame configured to cooperatively engage said table block to support said one or more side tables.

10. The workspace apparatus according to claim 1 further comprising one or more cushioning members disposed inside said lid body, said cushioning members configured to cushion and substantially prevent movement of said laptop computer when said laptop computer is enclosed between said lid and said top surface.

11. The workspace apparatus according to claim 1, wherein said lid body has a mouse housing configured to substantially enclose a computer mouse between said lid and said top surface.

12. The workspace apparatus according to claim 1, wherein said rolling means comprises one or more wheels rotatably disposed inside one or more wheel compartments at said back of said main compartment.

13. A portable workspace apparatus for use with a laptop computer, one or more computer peripherals and one or more work materials, said workspace apparatus comprising:

a main compartment having a front, a back, a pair of opposing sidewalls, a bottom and a substantially planar top surface forming one or more subcompartments having one or more storage spaces therein, said top surface sized and configured to receive and support said laptop computer;

a chair removably attached to said main compartment;

one or more doors attached to said main compartment and configured to enclose said one or more storage spaces, said doors configured to open and allow said chair to be positioned at said front of said main compartment for ergonomic use of said laptop computer when placed on said top surface;

a lid pivotally attached to said main compartment, said lid having a lid body sized and configured to substantially enclose said laptop computer between said lid and said top surface, said lid body having one or more cushioning members disposed therein, said cushioning members configured to cushion and substantially prevent movement of said laptop computer when said laptop computer is enclosed between said lid and said top surface;

a retractable handle assembly attached to said main compartment, said handle assembly having a handle storage housing, a handle configured to be received in said handle storage housing and a handle grip attached to said handle; and one or more wheels rotatably disposed inside one or more wheel compartments at said back of said main compartment.

14. The workspace apparatus according to claim 13, wherein said main compartment has one or more chair hangers sized and configured to releasably secure said chair to the exterior of one of said front, back or sidewalls of said main compartment.

15. The workspace apparatus according to claim 13, wherein said main compartment has a first subcompartment and a second subcompartment, said first subcompartment configured with a drawer slidably disposed in said main compartment, said second subcompartment configured with two or more storage spaces.

16. The workspace apparatus according to claim 13, wherein said work surface area further comprises one or more side tables pivotally attached to said main compartment and configured to move between a lowered position and a raised position.

17. The workspace apparatus according to claim 16 further comprising means attached to said main compartment for supporting said one or more side tables when placed in said raised position and means for securing said one or more side tables to said main compartment when placed in said lowered position.

18. The workspace apparatus according to claim 16, wherein said one or more side tables are in a generally planar relationship with said top surface when at said raised position to define a substantially planar working surface with said top surface.

19. A portable workspace apparatus for use with a laptop computer, one or more computer peripherals and one or more work materials, said workspace apparatus comprising:

a main compartment having a front, a back, a pair of opposing sidewalls, a bottom and a substantially planar top surface forming one or more subcompartments having one or more storage spaces therein, said top surface sized and configured to receive and support said laptop computer;

a chair removably attached to said main compartment;

one or more doors attached to said main compartment and configured to enclose said one or more storage spaces, said doors configured to open and allow said chair to be positioned at said front of said main compartment for ergonomic use of said laptop computer when placed on said top surface;

a lid pivotally attached to said main compartment, said lid having a lid body sized and configured to substantially enclose said laptop computer between said lid and said top surface, said lid body having one or more cushioning members disposed therein, said cushioning members configured to cushion and substantially prevent movement of said laptop computer when said laptop computer is enclosed between said lid and said top surface;

a retractable handle assembly attached to said main compartment, said handle assembly having a handle storage housing, a handle configured to be received in said handle storage housing and a handle grip attached to said handle;

one or more wheels rotatably disposed inside a one or more wheel compartments at said back of said main compartment; and one or more side tables pivotally attached to said main compartment and configured to move between a lowered position and a raised position, said one or more side tables in a generally planar relationship with said top surface when at said raised position to define a substantially planar working surface.

20. The workspace apparatus according to claim 19, wherein said main compartment has one or more chair hangers sized and configured to releasably secure said chair to the exterior of one of said front, back or sidewalls of said main compartment.

* * * * *